US006340156B1

(12) United States Patent
Sekita

(10) Patent No.: US 6,340,156 B1
(45) Date of Patent: Jan. 22, 2002

(54) SHEET-TRANSPORTING DEVICE AND IMAGE-FORMING APPARATUS

(75) Inventor: Itsuo Sekita, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/546,708

(22) Filed: Apr. 10, 2000

(30) Foreign Application Priority Data

May 13, 1999 (JP) ..... 11-132394

(51) Int. Cl.[7] ..... B65H 5/34

(52) U.S. Cl. ..... 271/270; 271/188; 271/10.1; 399/406

(58) Field of Search ..... 399/406; 271/10.01, 271/10.03, 10.11, 270, 202, 188

(56) References Cited

U.S. PATENT DOCUMENTS 4,451,027 A * 5/1984 Alper ..... 271/270
5,104,110 A * 4/1992 Haibara ..... 271/270
5,105,363 A * 4/1992 Dragon et al. ..... 271/270
5,295,060 A * 3/1994 Eckert et al. ..... 318/268
5,461,468 A * 10/1995 Dempsey et al. ..... 271/270
5,848,784 A * 12/1998 Tranquilla ..... 271/10.03
6,057,869 A * 5/2000 Kawaishi et al. ..... 347/153
6,170,816 B1 * 1/2001 Gillmann et al. ..... 271/270

FOREIGN PATENT DOCUMENTS

JP 6-312852 11/1994

* cited by examiner

*Primary Examiner*—H. Grant Skaggs
(74) *Attorney, Agent, or Firm*—Fitzpatrick, Cella, Harper & Scinto

(57) ABSTRACT

A structure including a transporting roller for transporting sheets; and a curling roller for transporting the sheets at a location downstream from the transporting roller in a sheet-transporting direction, the driving torque of the curling roller being larger than the driving torque of the transporting roller. The transporting roller and the curling roller are constructed so that their speeds can be switched from a first transporting speed to a second transporting speed which is greater than the first transporting speed. The time required to switch the speed of the curling roller from the first transporting speed to the second transporting speed is made longer than the time required to switch the speed of the transporting roller from the first transporting speed to the second transporting speed.

18 Claims, 8 Drawing Sheets

SHEET-TRANSPORTING DEVICE AND IMAGE-FORMING APPARATUS

BACKGROUND OF THE INVENTION

1. Field of the Invention

The present invention relates to a sheet-transporting device provided in various sheet-employing apparatuses, such as image-forming apparatuses and other office equipment. In such image-forming apparatuses, an appropriate transfer-type image-forming process (such as an electrophotographic-type image-forming process) or a direct-type image-forming process is used. Examples of the image-forming apparatus include printers, facsimile machines, and copying machines.

2. Description of the Related Art

FIG. 7 is a schematic structural view of a conventional image-forming apparatus comprising a sheet-feeding section and a register section which temporarily stops the leading edge of a recording sheet fed from the sheet-feeding section, forms a loop in the recording sheet to correct any oblique movement of the recording sheet, and sends the recording sheet to an image-forming section at a predetermined timing. The conventional image-forming apparatus roughly comprises an image-input section 90R and an image-output section 90P.

The image-input section 90R is, for example, an image information photo-reader mechanism. Image information to be recorded is input to the image-input section 90R, and variously processed. Then, an image signal carrying the image information is sent to the image-output section 90P. The image-input section 90R may be an optical device for exposing an image-carrying member of an image-forming section 91 of the image-output section 90P with light carrying an image of an original by projecting and focusing the light thereon.

The image-output section 90P is a transfer-type image-recording mechanism using a transfer drum 93. It comprises the image-forming section 91; first to third sheet-feeding units 92A to 92C, serving as sheet-feeding sections; a sheet-transporting section 97 disposed in front of a register roller pair 96 serving as a register section; a transfer drum 93; a fixing unit 94; and a control unit 95. The image-forming section 91 is used to form a transferable image, such as a toner image, on an image-carrying member, such as a photoelectric member, a dielectric member, or a magnetic member, by a suitable image-forming process, such as the electrophotographic-type image-forming process, an electrostatic-recording process, or a magnetic-recording process, in accordance with the image information input to the image-output section 90P. The sheet-transporting section 97 transports a recording sheet P fed from any one of the sheet-feeding units 92A to 92C to the register roller pair 96. The transfer drum 93 holds the recording sheet P transported from the register roller pair 96 and transports it to a transfer section T of the image-forming section 91. The fixing unit 94 fixes the image to the recording sheet P onto which the image has been transfer at the transfer section T of the image-forming section 91. The control unit 95 controls all of the operations of the image-forming apparatus.

The first and the second sheet-feeding units 92A and 92B are incorporated in the image-output section 90P as top and bottom mechanisms for automatically separating sheets one by one for feeding. Starting from the topmost recording sheet, the recording sheets P loaded in and held by a sheet-feed cassette are fed one sheet at a time as a result of cooperation of a corresponding sheet-feed roller and a corresponding separating member based on a sheet-feed start signal. The third sheet-feeding unit 92C is a manual sheet-feeding device. When it is used, a recording sheet P is inserted into the image-forming apparatus from a manual sheet-feed table, and is drawn into the image-forming apparatus in order to be fed to transfer section T.

When the image-forming apparatus starts to operate, a recording sheet P is fed from any one of the first to third sheet-feeding units 92A to 92C, and transported to the register roller pair 96 through the transporting section 97 by transporting roller pairs 98A, 98B, and 98C, and a curling roller set 99. The transporting roller pairs 98A to 98C and the curling roller set 99 can rotate in two different of rotational modes, or at two transporting speeds. In one mode, they rotate at ordinary transporting speeds. In the other mode, they rotate at speeds greater than the ordinary transporting speeds.

At the moment the edge of the recording sheet P fed from any one of the sheet-feeding units 92A to 92C is nipped by the corresponding first transporting roller pair (the transporting roller pair 98A if the sheet has been fed from the first sheet-feeding unit 92A; the transporting roller pair 98B if the sheet has been fed from the second sheet-feeding unit 92B; and the curling roller set 99 if the sheet has been fed from the third sheet-feeding unit 92C) rotating at the ordinary transporting speed, the ordinary transporting speeds of the pairs of transporting rollers 98A and 98B and the pair of curling rollers 99 are switched to the higher transporting speeds in order to transport the sheet to the register roller pair 96 at a high speed. By this speed-controlling operation, the time from the start of the sheet-feeding operation to the start of the image-forming operation can be reduced compared to that when the recording sheet is transported only at the ordinary transporting speed. The rotational speed of each roller is changed by switching the rotational speed of a corresponding motor (not shown), such as a stepping motor. Each motor is directly connected to its corresponding roller. For example, when the transporting speed is to be quadrupled from 150 mm/s to 600 mm/s, the number of rotations of the driving motor of each roller is increased by a factor of 4. In order to reduce loss of transporting speed, the speed switching is carried out in a short time period, that is, a time period of the order of 100 ms.

FIG. 4 illustrates the curling roller set 99 in detail. The pair 99 comprises two upper rollers 99A and 99B and one lower roller 99C. The two upper rollers 99A and 99B are pressed against the lower roller 99C by a spring or other biasing means (not shown). As shown in FIG. 4, when the recording sheet P passes between the two upper rollers 99A and 99B and the lower roller 99C, the recording sheet P is curled upward into a convex shape. When the recording sheet P is curled, the recording sheet P is more easily attracted to the transfer drum 93.

However, since the one lower roller 99C is pressed by the two upper rollers 99A and 99B, the driving torque of the curling roller set 99 is larger than those of the transporting roller pairs 98A and 98B. For example, while the driving torques of these transporting roller pairs 98A and 98B are of the order of 1 kgf·cm, the driving torque of the curling roller set 99 is of the order of 2.5 kgf·cm.

An image corresponding to relevant image information is formed on the image-carrying member in the image-forming section 91. In synchronism with an image-recording start signal, the register roller pair 96 starts to rotate, and the transporting section 97 returns to its recording-sheet-transporting state. The recording sheet P is transported from the register roller pair 96 to the rotating transfer drum 93, and held by the outer face of the rotating transfer drum 93 in order to be transported to the transfer section T. This causes the portions of the image formed on the image-carrying member of the image-forming section 91 to be successively transferred onto the recording sheet P.

There are several methods by which the recording sheet P can be held by the outer face of the transfer drum 93. The methods include electrostatic suction and air suction, towards a transporting medium, such as a thin dielectric film.

The timing at which the recording sheet P is transported by the register roller pair 96 is controlled such that when an edge of the image carried by the image-carrying member of the image-forming section 91 reaches the transfer section T, an edge of the recording sheet P is exactly at the transfer section T, whereby they are aligned (or subjected to registration).

The recording sheet P to which the image has been transferred at the transfer section T is separated from the outer face of the rotating transfer drum 93 and is transported to the fixing unit 94. The image on the recording sheet P is fixed thereto by heat and/or pressure, after which the recording sheet P passes through a sheet-discharge section and is discharged to a sheet-discharge tray disposed outside the image-forming apparatus. At the fixing unit 94, oil is applied to the recording sheet P in order to prevent it from being wound around the fixing rollers.

However, the conventional image-forming apparatus in which the rotational speeds of the sheet-transporting systems are controlled so that the rotational speeds are switched between two speeds has the following problems.

Since the rotational speeds of the transporting roller pairs 98A and 98B, and the curling roller set 99 are switched from low speeds to high speeds in about 100 ms, a very short time, large torques due to acceleration are produced during this short time. This may cause the rollers 99A and 99B, and the curling rollers 99 to rotate improperly due to large motor loads, or may cause sheet jamming resulting from the improper rotation. Since the inertial moments of the roller pairs 98A, 98B, and the curling roller set 99 are of the order of 2 kg·cm$^2$, acceleration torques in the order of 1.2 kgf·cm are produced when an attempt is made to quadruple the transporting speeds from 150 mm/s to 600 mm/s in the switching time of the order of 100 ms.

As mentioned above, the driving torques of the transporting roller pairs 98A and 98B are in the order of 1 kgf·cm, and of the curling roller set 99 is in the order of 2.5 kgf·cm. At the moment the speeds are switched, the aforementioned acceleration torques are added to the torque values corresponding thereto, so that the required driving torques of the transporting roller pairs 98A and 98B are 2.2 kgf·cm, while the required driving torque of the roller set 99 is 3.7 kgf·cm. Therefore, the driving motor used to rotationally drive the curling roller set 99 needs to be larger and to have a larger output than the driving motors used to rotationally drive the transporting roller pairs 98A and 98B.

However, the high-output, large motor used to rotationally drive the curling roller set 99 is more costly than the motors used to rotationally drive the transporting roller pairs 98A and 99B. In addition, this high-output, large motor is used at only one location, so that failures tend to occur when purchasing parts or during assembly. Further, it takes up a lot of space, thereby increasing the size of the image-forming apparatus.

One possible way to overcome the above-described problems is by replacing each member rotationally supporting each curling roller with a driving-load-reducing member, such as a bearing. This reduces the curling roller loads to a level equal to those on the transporting rollers.

However, since bearings are expensive, mounting driving-load-reducing members results in an increase in total costs. As shown in FIG. 4, the two upper rollers 99A and 99B are relatively small-diameter rollers and are spatially disposed close together. Therefore, when bearings or the like are inserted into the structure of the curling roller set 99, the structure becomes complicated.

Another way to overcome the above-described problems is by prolonging the time of switching the rotational speeds of the transporting roller pairs 98A and 98B, and the curling roller set 99 to, for example, a time in the order of 500 ms, as shown in FIG. 5. There is a discussion related to this method in, for example, Japanese Patent Laid-Open Publication No. 6-312852. When this method is used, the acceleration torques are reduced to levels in of the order of 0.2 kgf·cm, so that the driving torques of the transporting roller pairs 98A and 98B are reduced to values of the order of 1.2 kgf·cm, and the driving torque of the curling roller set 99 is reduced to a value of the order of 2.7 kgf·cm.

However, in this case, as shown in FIG. 5, the times required for accelerating the transporting roller pairs 98A and 98B and the curling roller set 99, are longer, so that the total amount that a recording sheet P is transported is reduced in correspondence with the delay times. Compared to the case where the transporting speeds are switched in 0.1 sec., the transportation of the recording sheet P is delayed by slightly less than 0.5 sec., so that it takes extra time to form an image, thus increasing the total image-forming time. In addition, during the switching between transporting speeds, the speeds actually become unstable as indicated by the solid lines in FIG. 8, so that prolonging the speed-switching time increases variables, such as the location to which the recording sheet P is transported. Therefore, failures caused by an unstable total controlling operation or sheet jamming caused by variations in the recording-sheet P location may result.

SUMMARY OF THE INVENTION

Accordingly, it is an object of the present invention to make it possible to eliminate the problem of size increases of an image-forming apparatus resulting from the use of a large motor. It is another object of the present invention to make it possible to eliminate the problem of increases in cost resulting from the addition of, for example, a bearing. It is still another object of the present invention to make it possible to eliminate the problem of lengthening of the total image-forming time caused by prolonging the time of switching between recording-sheet transporting speeds.

To this end, according to one aspect of the present invention, there is provided a sheet-transporting device comprising:

first transporting means for transporting sheets; and second transporting means for transporting the sheets at a location downstream from the first transporting means in a sheet-transporting direction, a driving torque of the second transporting means being greater than a driving torque of the first transporting means;

wherein a speed of the first transporting means and a speed of the second transporting means are each switchable between a first transporting speed and a second transporting speed which is greater than the first transporting speed; and wherein a time required to switch the speed of the second transporting means from the first transporting speed to the second transporting speed is longer than a time required to switch the speed of the first transporting means from the first transporting speed to the second transporting speed.

According to another aspect of the present invention, there is provided a sheet-transporting device comprising:

sheet-feeding means for feeding sheets;

first transporting means disposed downstream from the sheet-feeding means in a sheet-transporting direction; and second transporting means disposed downstream from the first transporting means in the sheet-transporting direction, with a driving torque of the second transporting means being greater than a driving torque of the first transporting means;

wherein when the sheets are being fed at a first transporting speed by the sheet-feeding means, the first transporting means and the second transporting means also rotate at the first transporting speed, and after a predetermined time from completion of sheet feeding, speed switching of the first transporting means and speed switching of the second transporting means from the first transporting speed to a second transporting speed that is greater than the first transporting means are started, with a time required to switch the speed of the second transporting means from the first transporting speed to the second transporting speed being longer than a time required to switch the speed of the first transporting means from the first transporting speed to the second transporting speed.

In accordance with yet another aspect of the present invention there is provided image forming apparatus which includes the above sheet transporting devices together with means for forming an image on the sheets transported thereby.

DESCRIPTION OF THE PREFERRED EMBODIMENTS

Hereunder, a detailed description will be given of embodiments of the image-forming apparatus comprising a sheet-transporting device to which the present invention is applied, with reference to the drawings. In the description below, an image-forming apparatus comprising a transfer drum for holding a sheet is taken as an example.

[First Embodiment]

Figure 1:
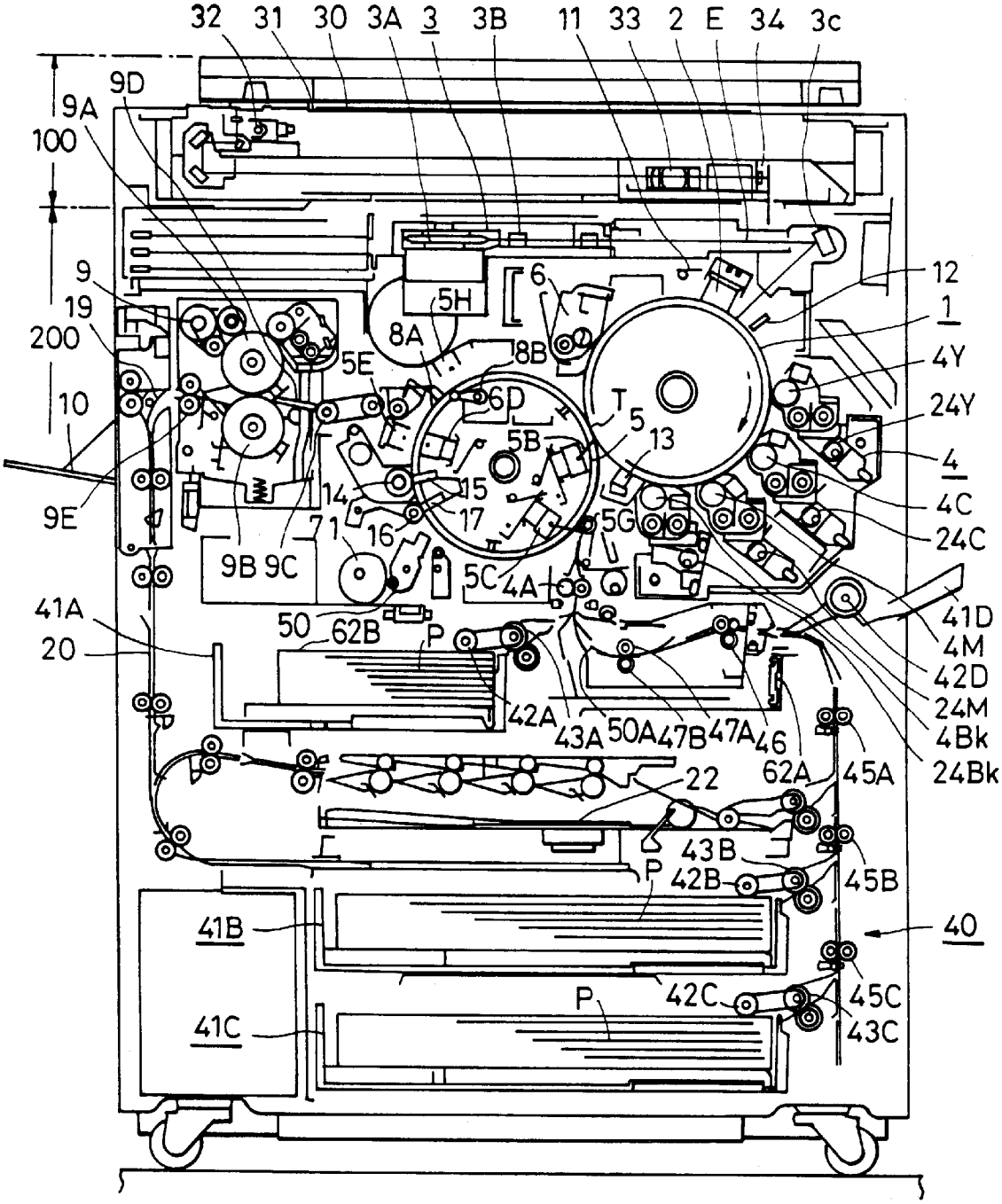
FIG. 1 is a schematic sectional view of the structure of an image-forming apparatus comprising a sheet-transporting device to which the present invention is applied.
Figure 2:
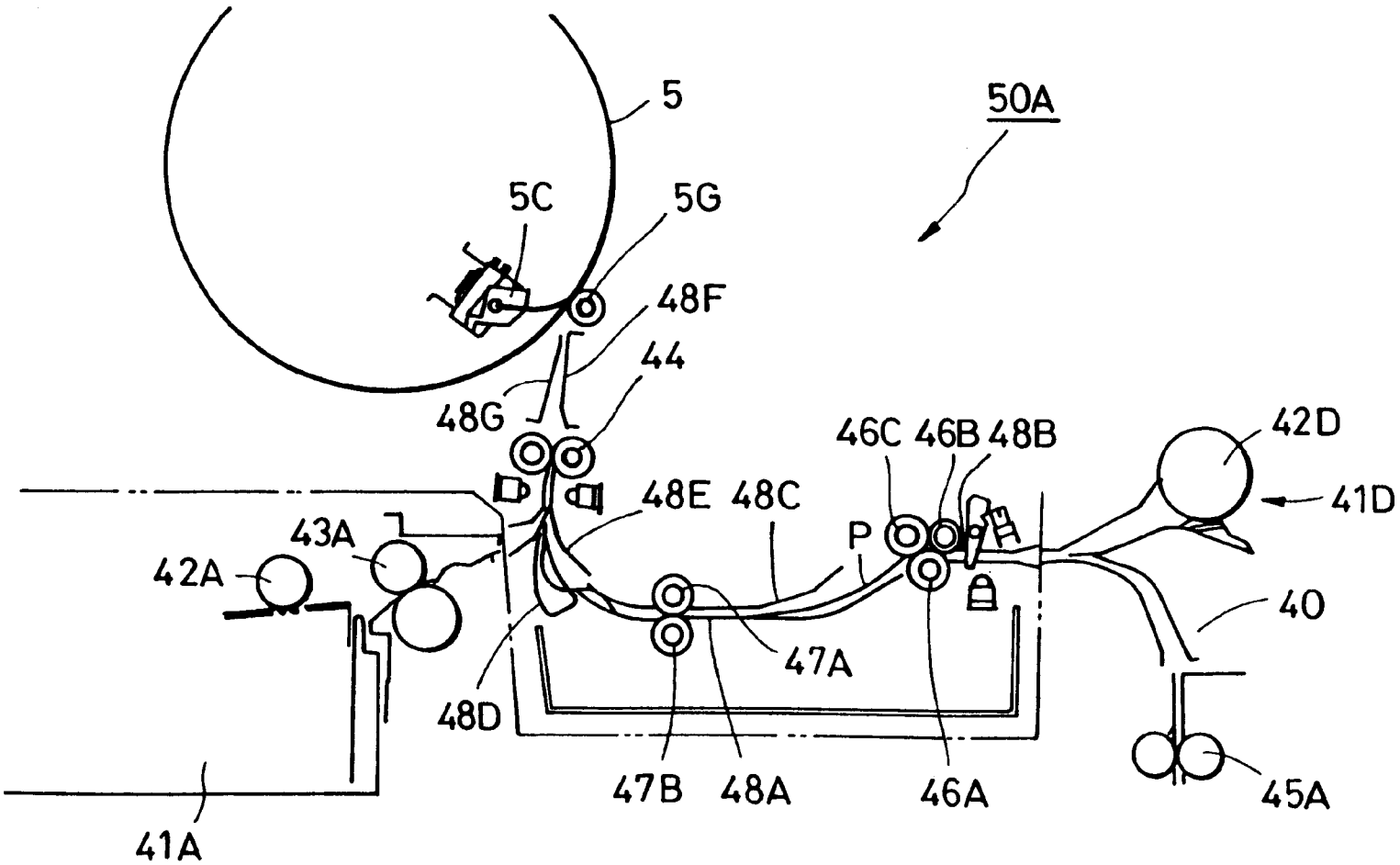
FIG. 2 is an enlarged schematic view of a transporting section of a transfer transporting unit in the image-forming apparatus.

A detailed description will be given of a first embodiment of the image-forming apparatus comprising a sheet-transporting device in accordance with the present invention, with reference to the drawings. FIG. 1 is a structural view of the first embodiment of the image-forming apparatus in accordance with the present invention.

The image-forming apparatus of the first embodiment is a color image-forming apparatus in which a transfer-type electrophotographic process is used. It comprises a digital color-image reader section 100 at the upper portion thereof, and a printer section 200 at the lower portion thereof.

(Reader section)

In the reader section 100, an original 30 is placed on an original-placing glass 31, and exposed and scanned using an exposure lamp 32. The light carrying the image reflected from the original 30 is gathered at a full-color sensor 34 by a lens 33, whereby a color-separation image signal is obtained. This signal travels through an amplifying circuit (not shown), is variously processed by a video-processing unit (not shown), and sent to the printer section 200.

(Image-forming mechanism of the printer section)

Reference numeral 1 denotes a photosensitive drum serving as an image-carrying member. It is rotationally driven clockwise (as indicated by the arrow in FIG. 1) around the center axis thereof at a predetermined peripheral speed (or process speed). An exposure lamp 11, a primary charger 2, an exposing optical system 3, such as a laser, an electrical potential sensor 12, a developing device 4, a transfer drum 5, and a cleaner 6 are sequentially disposed in that order in the direction of rotation of the photosensitive drum 1 so as to oppose the outer peripheral surface of the photosensitive drum 1.

The surface of the rotating photosensitive drum 1 is uniformly electrically charged by the exposing lamp 11 and the primary charger 2. Then, the photosensitive drum 1 is exposed to light beams E (such as laser beams) modulated in accordance with the recording image signal through a polygon mirror 3A, a lens 3B, and a mirror 3C of the optical system 3, whereby an electrostatic latent image is formed on the photosensitive drum 1.

The electrostatic latent image is developed by the developing device 4, which comprises four developing device sections. The four developing device sections are a yellow developing device section 4Y containing yellow developer or yellow toner, a cyan developing device section 4C containing cyan developer or cyan toner, a magenta developing device 4M containing magenta developer or magenta toner, and a black developing device 4BK containing black developer or black toner. The developing operation is carried out by alternately bringing eccentric cams 24Y, 24C, 24M, and 24BK near the photosensitive drum 1.

At the transfer section T, the portions of the toner image carried by the photosensitive drum 1 are successively transferred onto the surface of a recording sheet supplied to and held by the transfer drum 5, as described later.

After the image transfer, the recording sheet is separated from the transfer drum 5, and sent to the fixing unit 9 which fixes the transferred image on the recording sheet thereto. Then, the recording sheet is either discharged onto a sheet-discharge tray 10 disposed outside the image-forming apparatus or transported to a vertical sheet path 20 for two-side recording (described later) by a path-switching guide 19.

The fixing unit 9 comprises a fixing roller 9A and a presser roller 9B. The fixing roller 9A incorporates a heat source, such as a halogen lamp. The presser roller 9B (which may also incorporate a heat source) presses against the roller 9A. These two rollers 9A and 9B are used to fix the toner image by thermally fusing the toner on the recording sheet. Here, oil is applied to the upper fixing roller by an oil-applying roller in order to prevent the image from being transferred onto the upper fixing roller. However, oil may be applied to the recording sheet for the same purpose.

The fixing unit 9 also comprises a transporting belt 9C; an entrance guide 9D for guiding the recording sheet to a nip section between the rollers 9A and 9B; and a discharge roller 9E for guiding the recording sheet that has been transported from the rollers 9A and 9B out of the image-forming apparatus.

(Sheet-feeding unit)

In the embodiment of the image-forming apparatus, the sheet-feeding unit section is formed at the lower side of the above-described image-forming mechanism. It includes four sheet-feeding sections. They are a first sheet-feeding section 41A, a second sheet-feeding section 41B, a third sheet-feeding section 41C, and a fourth sheet-feeding section 41D. Three of the four sheet-feeding sections, that is, the first to third sheet-feeding sections 41A, 41B, and 41C, are disposed at the upper, intermediate, and lower portions of the sheet-feeding unit. They are mechanisms for automatically separating sheets one sheet at a time for feeding. The fourth sheet-feeding section 41D is a mechanism for manually feeding sheets.

As shown in FIGS. 1 to 6, starting from the topmost sheets, recording sheets P held by the first to third sheet-feeding sections 41A, 41B, and 41C are successively separated one sheet at a time by corresponding pick-up rollers 42A, 42B, and 42C, and fed by corresponding sheet-feed rollers 43A, 43B, and 43C. When a sheet-feeding section 41A, 41B, or 41C is specified, the pick-up roller of the specified sheet-feeding section 41A, 41B, or 41C is driven to selectively execute sheet feeding from the specified sheet-feeding section 41A, 41B, or 41C.

At the sheet-feeding sections 41B and 41C, the recording sheets P are fed at speeds of 150 mm/s. At the same time that the sheet feeding is carried out, corresponding transporting rollers 45B and 45C start to rotate at peripheral speeds of 150 mm/s. When the leading edge of the recording sheet P is nipped by transporting rollers disposed immediately behind the pick-up rollers 42B and 42C, the speeds of the transporting rollers 45B and 45C are changed to 600 mm/s.

As in conventional image-forming apparatus, the speeds of the transporting rollers are changed by switching the rotational speeds of motors (not shown), such as stepping motors, directly connected to the transporting rollers corresponding thereto. To quadruple the transporting speeds from 150 mm/s, or a first transporting speed, to 600 mm/s, or a second transporting speed, the numbers of rotations of the driving motors of the corresponding rollers are quadrupled. The speed-switching time is 100 ms to reduce loss of transportation time.

When, for example, sheet feeding is carried out from the lower sheet-feeding section 41C, the speed of the transporting roller 45C is changed to 600 mm/s when the transporting roller 45C nips a recording sheet P. This causes the recording-sheet transporting speed to be changed to 600 mm/s at the same time. Simultaneously with the speed changes of the lower sheet-feeding section 41C and the transporting roller 45C, the speeds of the transporting rollers 45B and 45A are also changed to 600 mm/s in the same speed-switching time of 100 ms, and the transporting rollers 45A and 45B wait for the recording sheet P. During the speed switching, each motor load torque is equal to 2.2 kgf·cm, which is the sum of the ordinary load torque of each transporting roller, or 1 kgf·cm, and the acceleration torque produced at each transporting roller, or 1.2 kgf·cm.

(Transfer transporting unit)

The recording sheet P that has been fed from any one of the first to fourth sheet-feeding sections 41A to 41D and an intermediate tray 22 moves into the transfer transporting unit 50.

The transfer transporting unit 50 roughly comprises a transporting section 50A and the transfer drum 5. Of the two sections, the transporting section 50A will be described with reference to FIG. 2, which is a partial enlarged view thereof. The transfer transporting unit 50 comprises guides 48A to 48E, transporting rollers 46A to 46C, and 47A and 47B, a register roller pair 44, and suction guides 48F and 48G. The guides 48A to 48E are used to guide a recording sheet P from a sheet-feeding unit 40. The register roller pair 44 are used to send the recording sheet P to the transfer drum 5 (described later) based on an image-forming timing at the image-forming section. The suction guides 48F and 48G are used to guide the recording sheet P based on the aforementioned timing.

The transporting rollers 46A, 46B, and 46C, being second transporting means, are curling rollers which are capable of curling the recording sheet P. At the same time that the sheet feeding is started, the curling rollers 46A, 46B, and 46C start to rotate at 150 mm/s, or the first transporting speed. At the same time that the speed of the transporting roller 45C starts to change, the speeds of the curling rollers 46A, 46B, and 46C start to change to 600 mm/s, or the second transporting speed. The speed-switching time is 500 ms, which is longer than 100 ms. During speed switching, each motor load torque is 2.7 kgf·cm, which is the sum of the ordinary load torque of each of the curling rollers 46A to 46C, or 2.5 kgf·cm, and each acceleration torque, or 0.2 kgf·cm. Since the total load of each of the curling rollers 46A to 46C does not greatly differ from the load torque (equal to 2.2 kgf·cm) of each of the transporting rollers 45A to 45C at the time of speed switching, they can be driven by similar driving motors.

The recording sheet P moves between the curling transporting rollers 46A to 46C which are rotating at transporting speeds of 600 mm/s as a result of the speed switching. Therefore, the recording sheet P is transported towards the register roller pair 44 without being wrinkled due to improper sheet transportation resulting from differences in speed.

Thereafter, by the transporting rollers 47A and 47B and the guides 48A to 48E, the recording sheet P is transported to the register roller pair 44. At this time, the register roller pair 44 is not rotating. An edge of the recording sheet P enters the nip section of the register roller pair 44. After a certain time therefrom, the driving of the transporting rollers 47A and 47B is stopped.

(Transfer drum)

Figure 3:
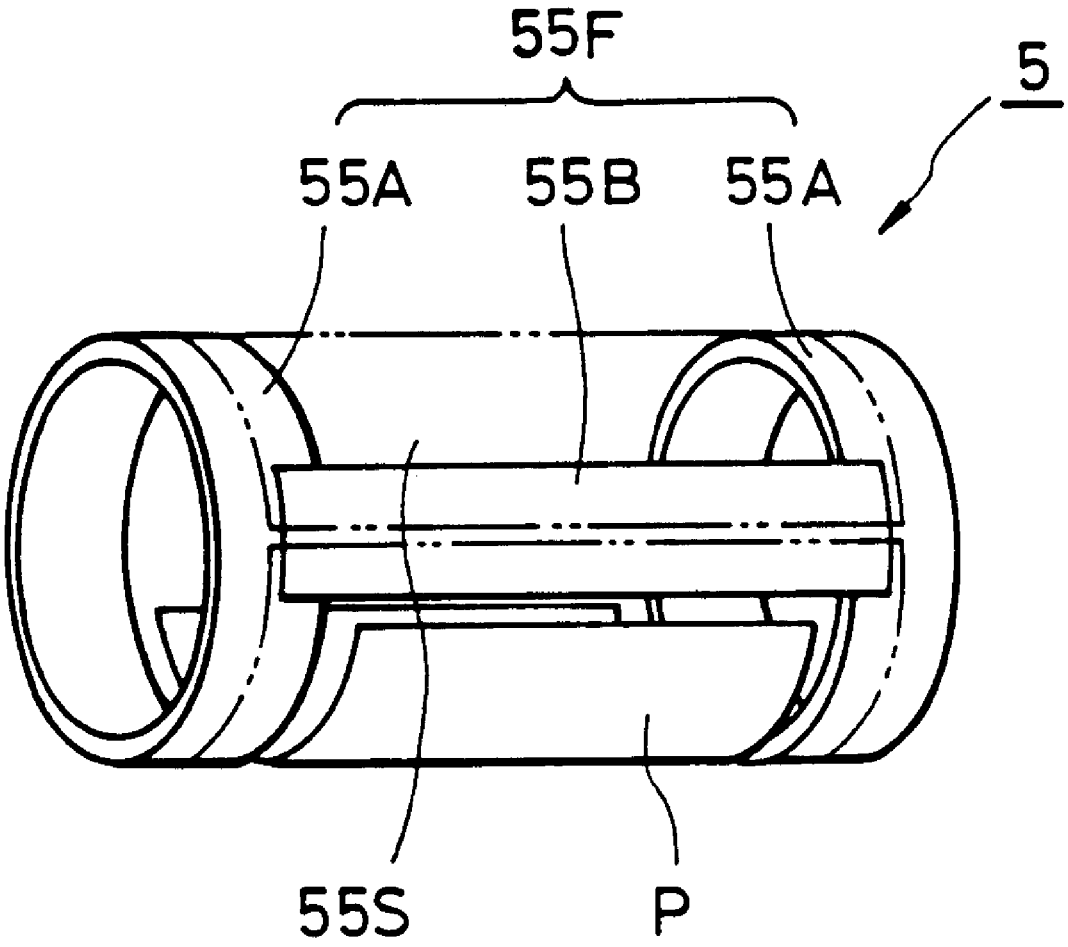
FIG. 3 is an enlarged perspective view of a transfer drum of the transfer transporting unit in the image-forming apparatus.
Figure 4:
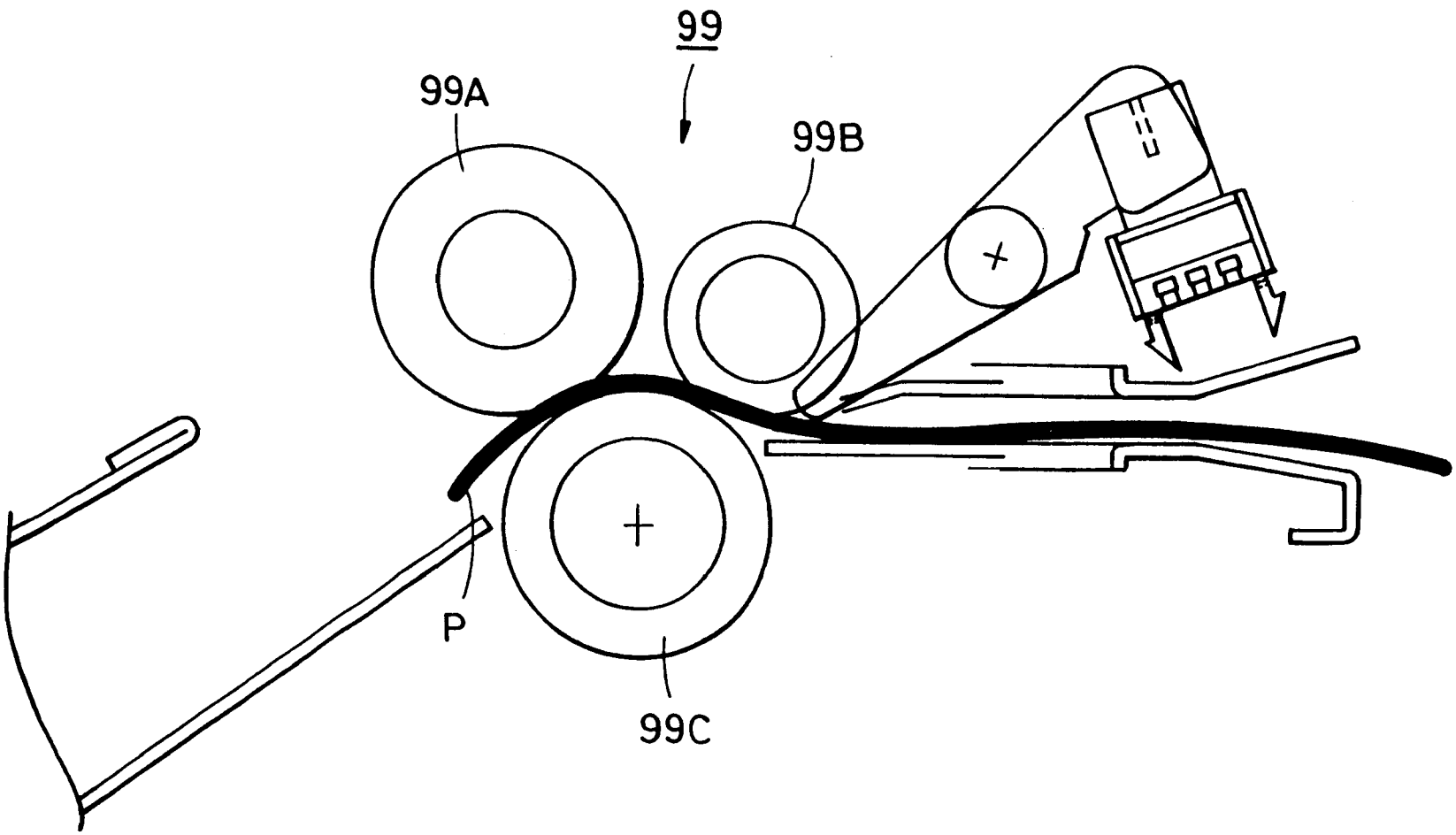
FIG. 4 illustrates in enlarged form a curling roller section.
Figure 5:
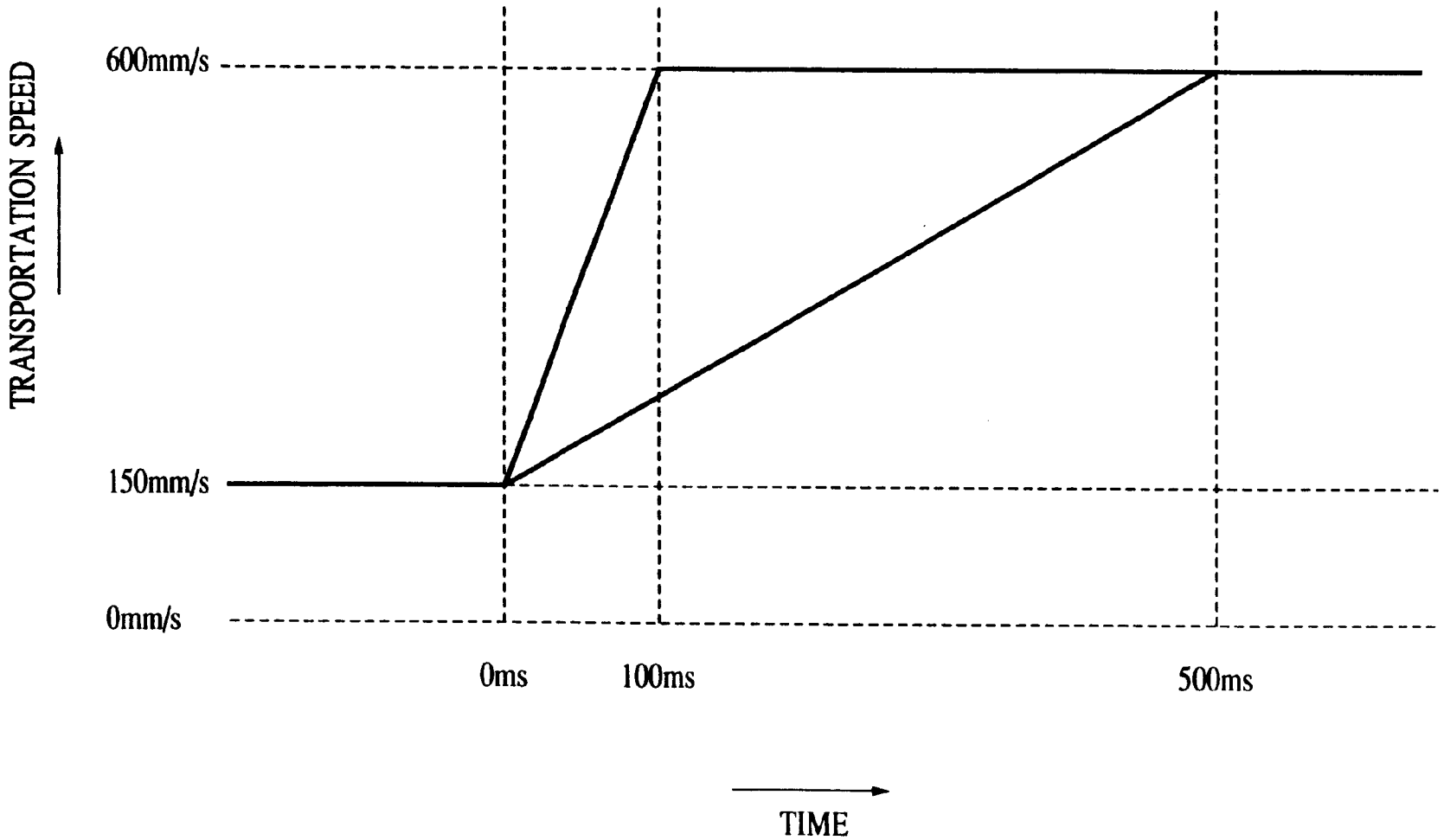
FIG. 5 shows a graph illustrating the relationship between the switchable roller transporting speed and the switching time.
Figure 6:
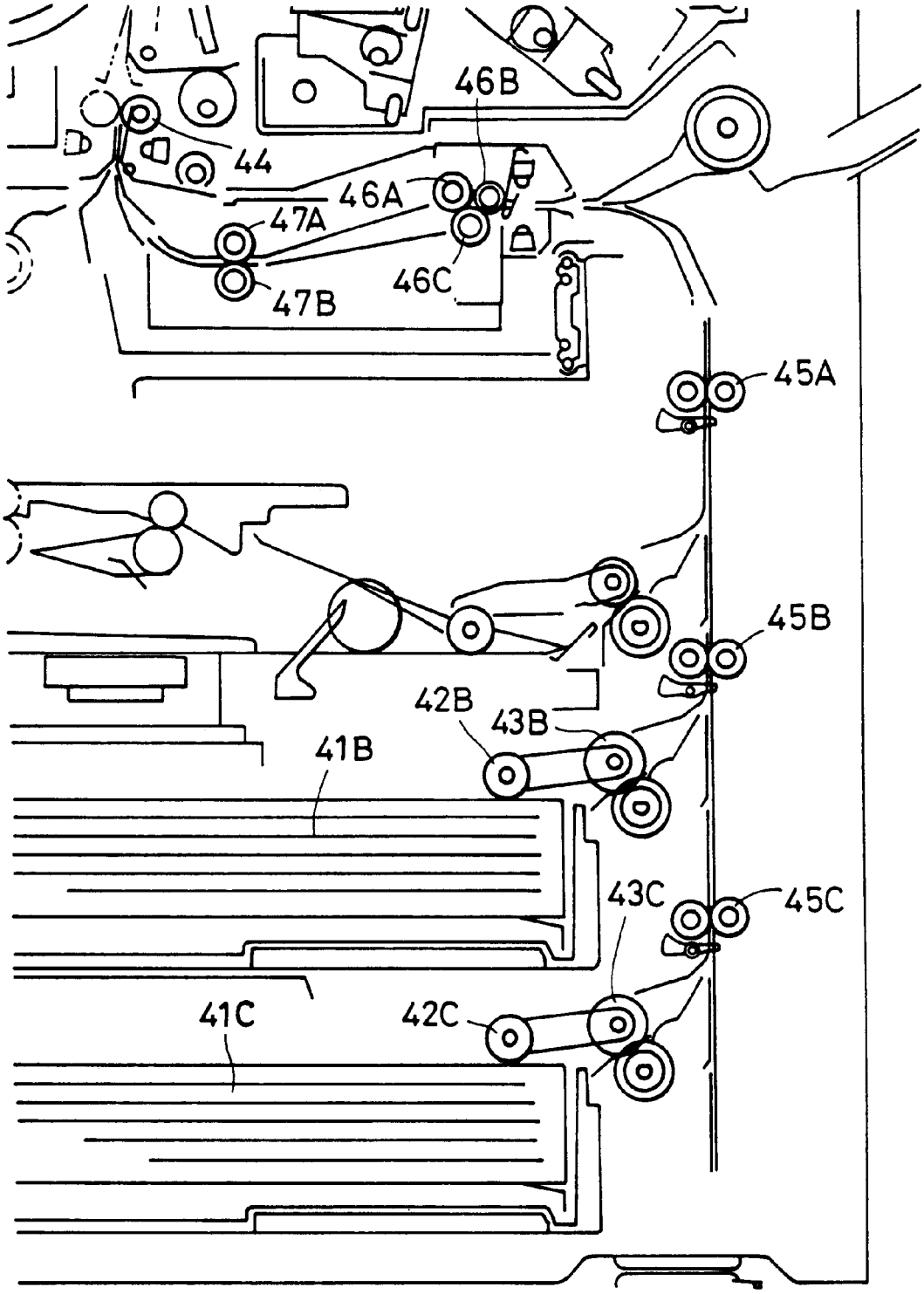
FIG. 6 is an enlarged schematic view of a transportation path extending from a sheet-feeding section to an image-forming section.
Figure 7:
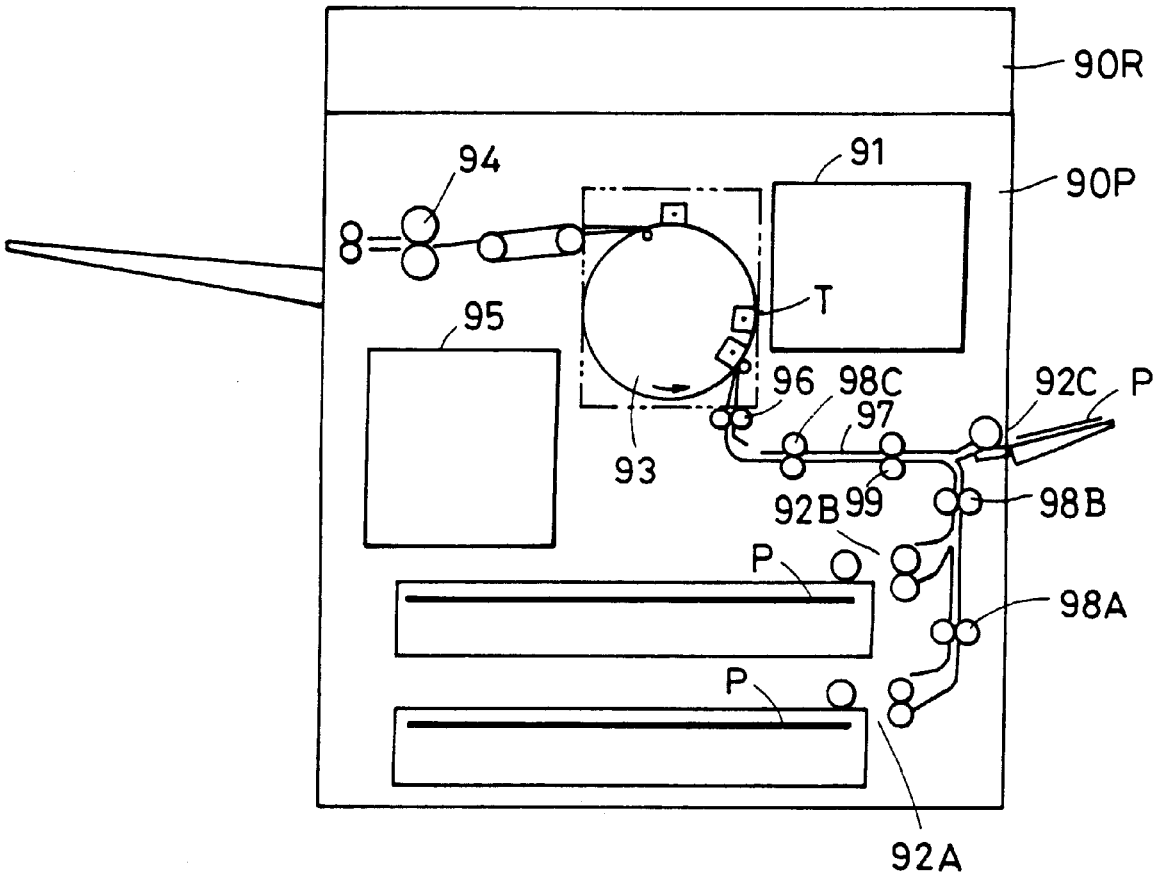
FIG. 7 PRIOR ART
FIG. 7 illustrates a conventional image-forming apparatus.
Figure 8:
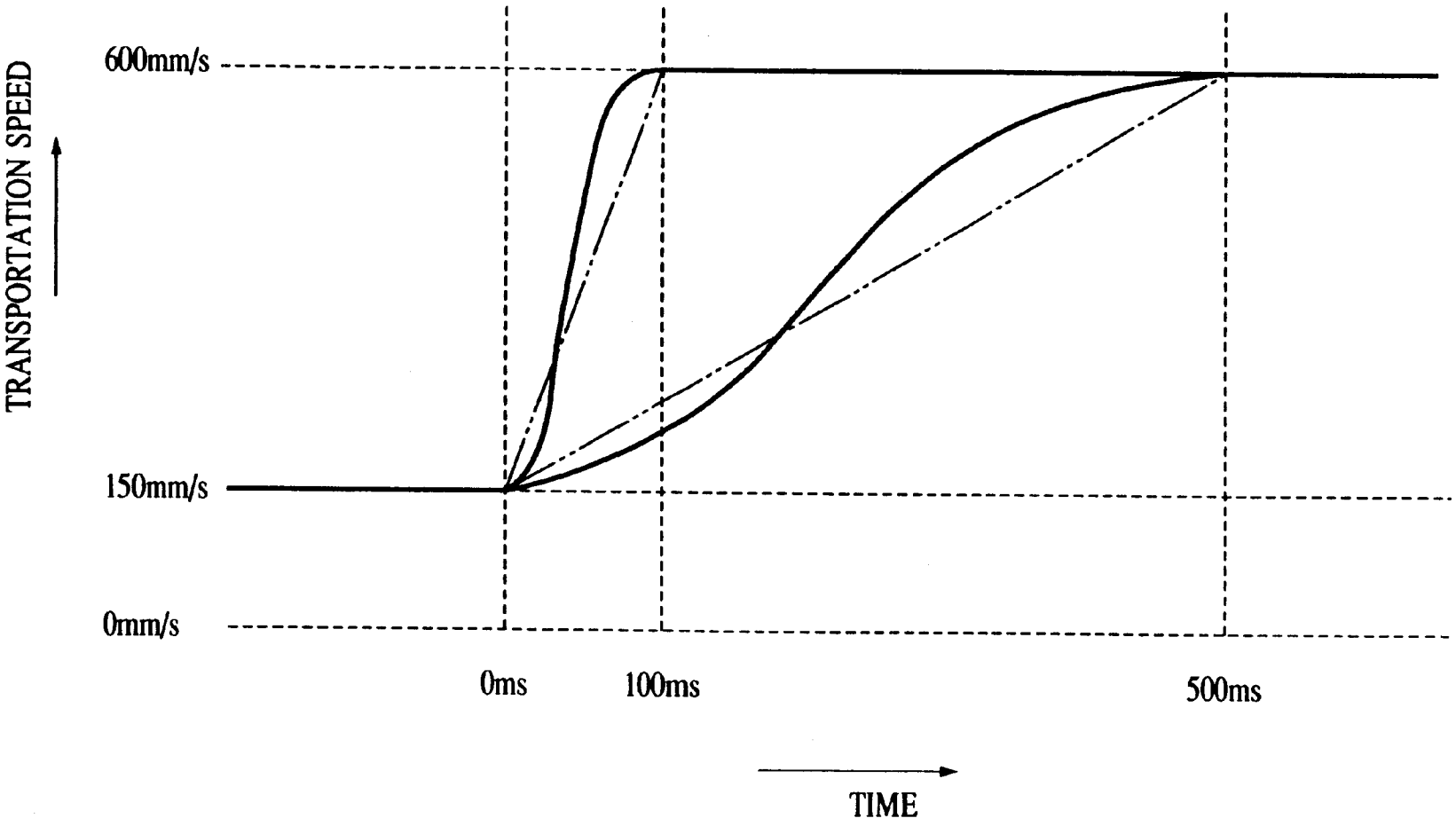
FIG. 8 shows a graph illustrating the relationship between the switchable roller transporting speed and the switching time in the conventional image-forming apparatus.

As shown in FIG. 3, the transfer drum 5 is formed by winding a recording-sheet-holding sheet film 55S so as to form a cylindrical shape onto a frame 55F. In the frame 55F, annular members 55A at both ends of the transfer drum 5 are coupled to each other by coupling members 55B. The film 55S is formed of, for example, PET (polyethylene terephthalate) or PVdF (polyvinylidene fluoride).

A suction roller 5G (see FIG. 2) is supported at a location corresponding to where the recording sheet P transported from the register roller pair 44 is forced onto the transfer drum 5. The suction roller 5G is supported so that it comes into contact with and separates from the transfer drum 5. A backup member and a suction charger 5C (see FIG. 2) are disposed opposite the suction roller 5G in order to oppose the pushing force of the suction roller 5G, with the film 55S being interposed between the suction roller 5G and the charger 5C.

A transfer charger 5B (see FIG. 1) is disposed at the back side of the film 55S, at an image transfer area (or transfer section) T where the photosensitive drum 1 and the transfer drum 5 oppose each other. Separating members (more specifically, a charge remover 5H, a separating pawl 8A, a film push-up roller 8B, etc.) are disposed downstream from the transfer charger 5B in order to separate the recording sheet P from the transfer drum 5. Film charge removers 5D and 5E are disposed downstream from the separating members, with the sheet film 55S being disposed therebetween.

A brush roller 14, a corona discharger or a brush-type charge remover 15, an oil-removing roller 16, and a backup brush 17 are provided downstream of the film charge removers 5D and 5E. The brush roller 14 and the corona discharger or the brush-type charge remover 15 are used to clean off toner, sheet dust, or other contaminants stuck on the recording-sheet holding surface of the film 55S. The oil-removing roller 16 and the backup brush 17 are used to clean off oil, used at the fixing unit 9, that sometimes sticks onto the film surface through the recording sheet P during printing on two sides (described later).

The transfer drum 5 is constructed so that it can come into contact with and separate from the photosensitive drum 1. Excluding the ordinary operation time, it is separated from the photosensitive drum 1 to prevent the transfer drum 5 and the photosensitive drum 1 from contacting each other for a long time, and to prevent the recording sheet P from coming into contact with and damaging the surface of the photosensitive drum 1 when eliminating jamming. In addition, the transfer transporting unit 50 is constructed so that it can be forwardly drawn out from the body of the image-forming apparatus by sliders 62A and 62B, thereby achieving reliable, easier jam elimination and maintenance.

(Color (multi-color) image recording)

When an image-forming-operation start signal is generated, a cam 71 undergoes half a rotation, causing the transfer drum 5 to rock so as to approach the photosensitive drum 1 and to move to an operating position. When it reaches the operating position, it rotates in synchronism with the photosensitive drum 1.

Thereafter, based on the timing in which the image-forming section forms the image, the register roller pair 44 and the transporting rollers 47A and 47B start to rotate. The time of rotation start is set so that rotation starts when the recording sheet P and the toner image on the photosensitive drum 1 are exactly aligned at the image-transfer area T.

When the recording sheet P is forced onto and comes into contact with the transfer drum 5, it is electrostatically attracted to the sheet film 55S by corona discharge, occurring at the suction charger 5C, and by the action of the suction roller 5G. The suction roller 5G is usually separated from the transfer drum 5 in order to reduce load. The suction roller 5G is press-contacted against the transfer drum 5 only when the recording sheet P is forced onto the transfer drum 5.

The transfer drum 5 rotates in synchronism with the photosensitive drum 1, and the recording sheet P, being kept on the transfer drum 5, is transported to the image-transfer area T. At the image-transfer area T, the toner image, formed on the photosensitive drum 1 by any one of the aforementioned image-forming processes, is transferred onto the surface of the recording sheet P by the transfer charger 5B. Instead, the recording sheet P with the transferred image is transported to the separating section.

Since a one-color image is transferred by one transfer operation, when the image is a one-color image, the recording sheet P is separated from the transfer drum 5 as described below. On the other hand, when a color image (formed with four different colors when it is a full-color image) is to be formed, the recording sheet P, being kept on the transfer drum 5, is rotated once and transported to the transfer area T again. It is not separated after one transfer operation. Instead, the next toner image is transferred onto the toner image formed by the first transfer operation. The transferring of a toner image onto the toner image or toner images already on the recording sheet P is repeated a necessary number of times. By carrying out transfer operations a multiple number of times, the toner images are synthesized to form the desired color (or full-color) image. The brush roller 14 and the other component parts at the transfer drum 5 are supported so that they can come into contact with and separate from the surface of the transfer drum 5. They are separated from the surface of the transfer drum 5 at least when multiple transfer operations are being carried out.

After completion of the multiple transfer operations, the charge remover 5H in the separating section reduces the force of attraction between the recording sheet P and the sheet film 55S of the transfer drum 5. Then, the recording sheet P is separated from the transfer drum 5 by the separating pawl 8A and the film push-up roller 8B.

The recording sheet P separated from the transfer drum 5 is transported to the fixing unit 9 by the transporting belt 9C, and precisely guided on the entrance guide 9D to the fixing roller nip section. Then, the toner image or the toner images are fixed to the surface of the recording sheet P by the heat generated from the fixing roller 9A. After the fixing operation, the recording sheet is transported by the sheet-feed roller 9E and discharged out of the image-forming apparatus. In the last step of the image-forming operation, the transfer drum 5 is separated from the photosensitive drum 1, and the image-forming apparatus stops operating.

As can be understood from the foregoing description, according to the embodiment of the image-forming apparatus constructed so that the transporting speeds of the transporting roller pairs and the curling roller set can be changed in order to reduce the time required to transport a recording sheet to the image-forming section, the speed-switching times of the rollers with large rotational loads (or large driving torques), such as curling rollers, are made longer than the speed-switching times of the other rollers not having large rotational loads. This makes it possible to provide a low-cost, stable image-forming apparatus which does not use a large driving motor and a driving-load reducing means, such as a bearing.

In addition, the rollers whose speed-switching times are long, that is, the rollers, such as curling rollers, having large driving loads have their speeds changed at timings in which a recording sheet is not nipped. Therefore, it is possible to prevent the recording sheet from becoming wrinkled when it is being transported.

[Other Embodiments]

Although in the above-described embodiment a copying machine was used as an example of the image-forming apparatus, the image-forming apparatus may be, for example, a scanner, a printer, or a facsimile machine. By applying the present invention to a sheet-transporting device used in any one of these image-forming apparatuses, similar effects can be obtained.

Although in the above-described embodiment a sheet-transporting device for feeding recording sheets was used, a sheet-transporting device for transporting, for example, originals in sheet form from which information is read may also be used. Even in this case, similar effects can be obtained.

Although in the above-described embodiment an electrophotographic method was used as the recording method, other types of recording methods, such as the inkjet method, may also be used.

As can be understood from the foregoing description, according to the image-forming apparatus of the present invention in which the transporting speeds of the transporting means can be changed, the transporting-speed-switching times of the transporting means having large driving torques, such as curling rollers, are made longer than the transporting-speed-switching times of the rollers not having large driving torques. Therefore, it is possible to provide a low-cost, stable image-forming apparatus which uses neither a large driving motor nor a driving load reducing means, such as a bearing.

Further, since the speeds of the transporting means, such as curling rollers, having long speed-switching times or having large driving torques are changed at a timing in which a sheet is not nipped, it is possible to prevent wrinkles from becoming formed on the sheet being transported.

While the present invention has been described with respect to what is presently considered to be the preferred embodiments, it is to be understood that the invention is not limited to the disclosed embodiments. The present invention is intended to cover various modifications and equivalent arrangements included within the spirit and scope of the appended claims.

What is claimed is:

1. A sheet-transporting device comprising:

first transporting means for transporting sheets, said first transporting means having a first driving torque; and second transporting means for transporting the sheets at a location downstream from said first transporting means in a sheet:-transporting direction, said second transporting means having a second driving torque, the second driving torque being greater than the first driving torque;

wherein a speed of the first transporting means and a speed of the second transporting means are each switchable between a first transporting speed and a second transporting speed which is greater than the first transporting speed; and wherein a time required to switch the speed of the second transporting means from the first transporting speed to the second transporting speed is longer than a time required to switch the speed of the first transporting means from the first transporting speed to the second transporting speed.

2. A sheet-transporting device according to claim 1, wherein the speed of the second transporting means is switched to the second transporting speed before the sheets reach the second transporting means.

3. A sheet-transporting device according to claim 1, further comprising:

first driving means connected to said first transporting means for driving said first transporting means; and second driving means connected to said second transporting means for driving said second transporting means.

4. A sheet-transporting device according to claim 3, wherein each of said first driving means and said second driving means are stepping motors.

5. A sheet-transporting device according to claim 1, wherein said second transporting means curls the sheet.

6. A sheet-transporting device according to claim 5, wherein said second transporting means comprises a first roller member, a second roller member, and a third roller member, wherein the second roller member and the third roller member are contactable with the first roller member and wherein the sheets pass between a first contact portion where the first roller member and the second roller member contact each other, and a second contact portion where the first roller member and the third roller member contact each other.

7. A sheet-transporting device comprising:

sheet-feeding means for feeding sheets;

first transporting means disposed downstream from the sheet-feeding means in a sheet-transporting direction, said first transporting means having a first driving torque; and second transporting means disposed downstream from the first transporting means in the sheet-transporting direction, said second transporting means having a second driving torque, the second driving torque of the second transporting means being greater than the first driving torque of the first transporting means;

wherein when the sheets are being fed at a first transporting speed by the sheet-feeding means, the first transporting means and the second transporting means also rotate at the first transporting speed, and after a predetermined time from completion of sheet feeding, speed switching of the first transporting means and speed switching of the second transporting means from the first transporting speed to a second transporting speed that is greater than the first transporting speed are started, with a time required to switch the speed of the second transporting means from the first transporting speed to the second transporting speed being longer than a time required to switch the speed of the first transporting means from the first transporting speed to the second transporting speed.

8. A sheet-transporting device according to claim 7, wherein before the sheets reach the second transporting means, the speed of the second transporting means is switched to the second transporting speed.

9. A sheet-transporting device comprising:

sheet-feeding means for feeding sheets;

first transporting means disposed downstream from the sheet-feeding means in a sheet-transporting direction, said first transporting means having a first driving torque; and second transporting means disposed downstream from the first transporting means in the sheet-transporting direction, said second transporting means having a second driving torque, the second driving torque of the second transporting means being greater than the first driving torque of the first transporting means;

wherein when the sheets are being fed at a first transporting speed by the sheet-feeding means, the first transporting means and the second transporting means also rotate at the first transporting speed, and after the fed sheets have reached the first transporting means, speed switching of the first transporting means and speed switching of the second transporting means from the first transporting speed to a second transporting speed which is greater than the first transporting speed are started, with a time required to switch the speed of the second transporting means from the first transporting speed to the second transporting speed being longer than a time required to switch the speed of the first transporting means from the first transporting speed to the second transporting speed.

10. A sheet-transporting device according to claim 9, wherein before the sheets reach the second transporting means, the speed of the second transporting means is switched to the second transporting speed.

11. An image-forming apparatus comprising:

first transporting means for transporting sheets, said first transporting means having a first driving torque; and second transporting means for transporting the sheets at a location downstream from said first transporting means in a sheet-transporting direction, said second transporting means having a second driving torque, the second driving torque being greater than the first driving torque;

wherein a speed of the first transporting means and a speed of the second transporting means are each switchable between a first transporting speed and a second transporting speed which is greater than the first transporting speed;

wherein a time required to switch the speed of the second transporting means from the first transporting speed to the second transporting speed is longer than a time required to switch the speed of the first transporting means from the first transporting speed to the second transporting speed; and image forming means for forming an image on the sheets transported by the first and second transporting means.

12. An image-forming apparatus according to claim 11, wherein the speed of the second transporting means is switched to the second transporting speed before the sheets reach the second transporting means.

13. An image-forming apparatus according to claim 11, further comprising:

first driving means connected to said first transporting means for driving said first transporting means; and second driving means connected to said second transporting means for driving said second transporting means.

14. An image-forming apparatus according to claim 13, wherein each of said first driving means and said second driving means are stepping motors.

15. An image-forming apparatus according to claim 11, wherein said second transporting means curls the sheet.

16. An image-forming apparatus according to claim 15, wherein said second transporting means comprises a first roller member, a second roller member, and a third roller member, wherein the second roller member and the third roller member are contactable with the first roller member; and wherein the sheets pass between a first contact portion where the first roller member and the second roller member contact each other, and a second contact portion where the first roller member and the third roller member contact each other.

17. An image-forming apparatus comprising:

sheet-feeding means for feeding sheets;

first transporting means disposed downstream from the sheet-feeding means in a sheet-transporting direction, said first transporting means having a first driving torque;

second transporting means disposed downstream from the first transporting means in the sheet-transporting direction, said second transporting means having a second driving torque, the second driving torque of the second transporting means being greater than the first driving torque of the first transporting means;

wherein when the sheets are being fed at a first transporting speed by the sheet-feeding means, the first transporting means and the second transporting means also rotate at the first transporting speed, and after a predetermined time from completion of sheet feeding, speed switching of the first transporting means and speed switching of the second transporting means from the first transporting speed to a second transporting speed that is greater than the first transporting speed are started, with a time required to switch the speed of the second transporting means from the first transporting speed to the second transporting speed being longer than a time required to switch the speed of the first transporting means from the first transporting speed to the second transporting speed; and image forming means for forming an image on the sheets transported by the first and the second transporting means.

18. An image forming apparatus comprising:

sheet-feeding means for feeding sheets;

first transporting means disposed downstream from the sheet-feeding means in a sheet-transporting direction, said first transporting means having a first driving torque;

second transporting means disposed downstream from the first transporting means in the sheet-transporting direction, said second transporting means having a second driving torque, the second driving torque of the second transporting means being greater than the first driving torque of the first transporting means;

wherein when the sheets are being fed at a first transporting speed by the sheet-feeding means, the first transporting means and the second transporting means also rotate at the first transporting speed, and after the fed sheets have reached the first transporting means, speed switching of the first transporting means and speed switching of the second transporting means from the first transporting speed to a second transporting speed which is greater than the first transporting speed are started, with a time required to switch the speed of the second transporting means from the first transporting speed to the second transporting speed being longer than a time required to switch the speed of the first transporting means from the first transporting speed to the second transporting speed; and image forming means for forming an image on the sheets transported by the first transporting means and the second transporting means.

* * * * *

UNITED STATES PATENT AND TRADEMARK OFFICE

CERTIFICATE OF CORRECTION

PATENT NO. : 6,340,156 B1
DATED : January 22, 2002
INVENTOR(S) : Itsuo Sekita

It is certified that error appears in the above-identified patent and that said Letters Patent is hereby corrected as shown below:

Column 1,
Line 58, "transfer" (1st occurrence) should read --transferred --.

Column 2,
Line 13, "of" should be deleted.

Column 5,
Line 45, "in" should read -- in a --.

Column 11,
Line 8, "in" should read -- in a --.
Line 44, "sheet:-transporting" should read -- sheet-transporting --.

Signed and Sealed this

Twenty-eighth Day of May, 2002

*Attest:*

*Attesting Officer*

JAMES E. ROGAN
*Director of the United States Patent and Trademark Office*